United States Patent [19]

Grosman

[11] Patent Number: 4,711,601

[45] Date of Patent: Dec. 8, 1987

[54] METHOD OF INSTALLING OFFSHORE CONSTRUCTIONS

[76] Inventor: Isaac Grosman, Julian Alvarez 2427, Buenos Aires, Argentina

[21] Appl. No.: 892,878

[22] Filed: Jul. 28, 1986

Related U.S. Application Data

[63] Continuation of Ser. No. 740,317, Jun. 3, 1985, which is a continuation of Ser. No. 536,249, Sep. 27, 1983, abandoned.

[51] Int. Cl.[4] ..... E02B 17/00; E02D 5/00

[52] U.S. Cl. ..... 405/204; 405/195

[58] Field of Search ..... 405/166, 169–171, 405/195, 203–210, 224

[56] References Cited

U.S. PATENT DOCUMENTS

| | | | |
|---|---|---|---|
| 2,865,179 | 12/1958 | McNeill | 405/204 |
| 2,935,854 | 5/1960 | Thompson et al. | 405/204 |
| 3,273,526 | 9/1966 | Glosten | 405/205 X |
| 3,717,002 | 2/1973 | O'Brien et al. | 405/170 |
| 3,858,402 | 1/1975 | Baker et al. | 405/205 X |
| 3,924,415 | 12/1975 | Goren et al. | 405/166 |
| 3,927,535 | 12/1975 | Giblon | 405/224 X |
| 4,094,162 | 6/1978 | Allee | 405/207 X |
| 4,257,720 | 3/1981 | Ostgaard | 405/224 X |
| 4,293,239 | 10/1981 | Petty et al. | 405/203 X |

FOREIGN PATENT DOCUMENTS 2510656 9/1976 Fed. Rep. of Germany ..... 405/207

*Primary Examiner*—Cornelius J. Husar
*Assistant Examiner*—Nancy J. Stodola
*Attorney, Agent, or Firm*—Frishauf, Holtz, Goodman & Woodward

[57] ABSTRACT

A method of installing an offshore construction, includes fabricating platform support columns from a plurality of interconnected column sections. The method comprises placing a first column section at the surface of a body of water, at least partly submerging the first column section by a certain amount, placing a second column section on top of the first column section whereby the top of the first column section is joined to the bottom of the second section near the waters' surface, the second column section thereafter being at least partly submerged as was the first column section. Additional column sections are placed on top of and joined to successive partly submerged column sections near the waters' surface, until a finished column of desired height is formed by the joined column sections. A base may be initially connected to the bottom of the first column section. The finished column may then be anchored to the seabed to maintain the finished column in a fixed vertical position. After a number of columns are formed, they may be braced together and the individual anchoring can be removed. The column can be disassembled and the column sections can be re-used.

22 Claims, 17 Drawing Figures

METHOD OF INSTALLING OFFSHORE CONSTRUCTIONS

This application is a continuation of Ser. No. 740,317, filed June 3, 1985, which in turn is a Continuation of Ser. No. 536,249, filed Sept. 27, 1983 (now abandoned).

BACKGROUND OF THE INVENTION

The present invention relates generally to methods of installing offshore constructions such as platforms, wherein a number of supporting columns have bases which rest or are fixed on a seabed, and a platform is supported at the tops of the columns above the waters' surface. In particular, the present method relates to the joining of a number of column sections in situ to form finished columns of desired height based at selected positions on the seabed.

Until now, fixed offshore platforms for exploration or production of oil or gas, have been basically of two different kinds, namely, metal jackets and gravity structures.

Metal jackets are set out on the sea bottom and secured by means of piles which are either driven, or drilled and driven down to depths of about 100–150 meters. For waters up to 300 meters deep and platforms emerging about 30 meters above sea level, the total length of the piles may therefore exceed 480 meters each. Anchoring of piles of such length requires very heavy and costly pile-driving hammers.

Some of the limitations in the use of metal or steel jackets are as follows:

The need for careful previous reconnaissance undertakings, so as to obtain the necessary data for the correct design and installation of the platform. An initial geophysical reconnaissance of the site requires coverage of a considerable area because of the uncertainty of the final position of the structure. A careful bathymetry is needed, to determine the gradient and irregularities of the relief (mounds and hollows) of the seabed. Careful use of an echo sounder, side-scan sonar, penetrometer, magnetometer, and the like is necessary. Also, seismic prospection is a must, to verify the continuity of the strata and to detect the possibility of geological accidents.

Such reconnaissance undertakings sometimes take two or more years before the structure can be designed, and a very precise delimitation of the site selected to install the platform must be performed. Due to the difficulties in determining with reasonable accuracy the bearing capacity and pullout force of each pile, overdimensioning of the structure (both in number of piles and their diameter and length) is not uncommon, in order to obtain a satisfactory safety factor. Nevertheless, the effect of lateral forces (i.e., waves and currents in the submerged portions, and winds in the emerged parts), liquefaction of the soil under the driving force and recovery, scour near the piles and a considerable concentration of the loads owing to the short number of the piles, results in fairly significant movements of the structure which create a dangerous condition for linking elements such as conductors, risers, drilling strings and the like.

A coastal yard for fabrication of the jacket, equipped with heavy cranes to handle the large structure and to put it afloat on expensive barges, raises the cost of the finished platform by a significant amount. Moreover, towing the jacket to the final location, launching and positioning the heavy structure onto the selected final site, are very costly and time consuming operations which can only be performed under favorable weather and oceanographic conditions during short periods of the year.

Other limitations on the use of steel jacket platforms arise in that installation loads (during launching and upending the jacket) are higher than the loads prevalent during the entire life of the structure, and yet determine overdimensioning of many important members of the structure thereby increasing unnecessarily the cost of the platform. Also, cathodic protection of all the structure is required in order to prevent corrosion, and, once the jacket is installed, construction of oil or gas pipelines is needed before exploitation of the platform can begin. Further, the distance from coastal storage facilities, or existing pipelines, limits the feasibility of the metal jacket platforms.

Fixed offshore platforms of the gravity structure type are generally built of reinforced or pre-stressed concrete, or with a concrete base carrying steel lattice structures. Such gravity structures are used as production platforms or as tanks for storage at sea, and are built on a deep water coastal site, and then towed to the immersion point. The structures are made stable by gravity on account of the dimensions and weight of the base (generally of concrete), so that no anchoring is required at the bottom.

Prior to installation, reconnaissance of the sea bottom must be carefully carried out. Bathymetry must yield a highly precise description of the topography of the bottom including flatness and horizontality; seismic prospecting requires rigorous interpretation to determine geological anomalies which may exist near the surface of the seabed; and geotechnical reconnaissance including coring and in situ measurements such as penetrometry down to depths of 20 to 30 meters, and deep coring to about 100 meters, also are required.

Installation of a gravity structure thus is governed by the topography of the sea bottom and the mechanical characteristics of the surface soil. Placement of the structure raises, among other problems, that of contact stresses between the soil and the foundation slab due to irregularities of the sea bottom. Such contact stresses depend on the topography of the site and the characteristics of the soil. This calls for an accurate knowledge of the topography and formulae for the bearing capacity and elastic deformations of the soil.

In practice, it is not possible to obtain a highly accurate map of the irregularities of the soil surface, so that the structure is invariably designed for some degree of broken surface conditions at the bottom. Accordingly, the foundation slab is always overdimensioned.

Usually, gravity structures are designed to be located only on highly consolidated soils such as sands and clays. It is required that the height of the domes of the seabed be no more than a few tens of centimeters and the slope of the bottom be less than 1%. Too great a soil settlement under the effect of repeated loads, tends to ruin the foundation slab and, therefore, damage the structure and linking elements such as conductors, risers and the like.

When transported from a coastal construction dock to the immersion site, a gravity structure may be subjected to unexpected bad weather or oceanographic conditions so that the structure also must be overdimensioned to prevent any damage along such hazardous towing trip.

SUMMARY OF THE INVENTION

An object of the present invention is to provide a method of installing an offshore construction is substantially less time than needed with the known methods, so that very significant cost reductions can be realized.

A further object of the invention is to provide a method of installing an offshore construction whereby the shape of the construction can be gradually modified and its size can be enlarged.

A further object of the invention is to provide a method of installing offshore constructions whereby reconnaissance of the sea soils can be performed in a relatively short time, in good or bad weather and with improved accuracy.

Another object of the invention is to provide a method of installing offshore constructions wherein necessary coring, penetrometry, geological exploration, and sonar and side-scan determinations can be done with high accuracy and under any weather conditions over substantially the entire year.

Another object of the invention is to provide a method of installing offshore constructions which would allow, at relatively low cost, the erection of radar, sonar, satellite stations and the like which installations may be useful for various purposes at any distance from a coastline.

Yet another object of the invention is to provide a method of installing offshore constructions capable of supporting stations for scientific observation of animal and vegetable life at sea, analysis of the sea water at different depths, and research of the marine environment for long periods of time at relatively low cost.

Still another object of the invention is to provide a method of installing offshore constructions as would allow installation of missile silos offshore, either partially or completely submerged.

According to the invention, a method of installing an offshore construction includes the steps of providing a number of hollow supporting column sections, and providing a column base member. The column base member is placed near the waters' surface, preferably at least partly below the water' surface. A first column section is placed on top of the column base member and the bottom of the first column section is joined to the base member near the waters' surface, the first column section thereafter being at least partly submerged. A second column section is placed on top of the first column section, and the top of the first column section is joined to the bottom of the second column section near the waters' surface, the second column section thereafter being at least partly submerged. Additional column sections are placed on top of the at least partly submerged column sections and joined to the tops of the at least partly submerged column sections near the waters' surface until a finished column of desired height is formed. The finished column including the column base either rests on the seabed or is anchored to the seabed so as to be maintained in a vertical position.

A number of finished columns can be erected and fixed relatively to the seabed to support a platform of desired size. When a number of columns are used, they are interconnected together. In the interconnected state, anchoring of the columns to the seabed to maintain them vertical is not required. However, the individual columns are preferably temporarily anchored to the seabed to keep them vertical before the columns' are interconnected together.

The entire operation can be performed at sea without the requirement of constructing and transporting whole supporting columns and compelte platforms as in the past.

Preferably, the sections of each column are of substantially the same cross-sectional configuration, and they may have substantially the same height. Different height column sections can be used at the top end to level the tops to compensate for uneven seabeds.

The hollow columns are preferably fabricated with a substantial buoyancy so that installation of very high and very heavy columns can be carried out with conventional hoisting systems presently in use on many boats. Due to the buoyancy of the at least partially submerged column sections, the loading on the hoisting system is reduced, thereby eliminating the necessity for heavy cranes or heavy equipment to construct the platform and supporting columns.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE INVENTION

Figure 1A:
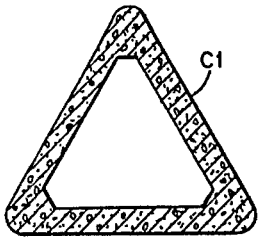
FIGS. 1(a)–(f) are cross-sectional views of different column sections which may be used in the method of the present invention.
Figure 1B:
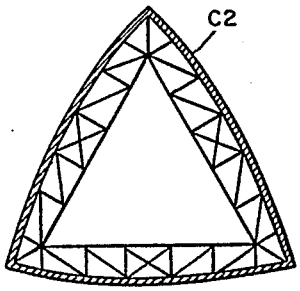
Figure 1C:
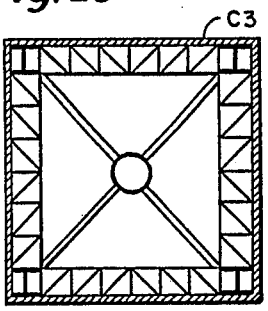
Figure 1D:
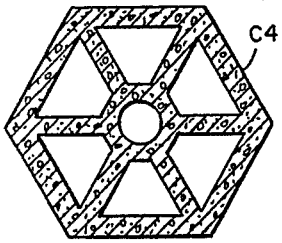
Figure 1E:
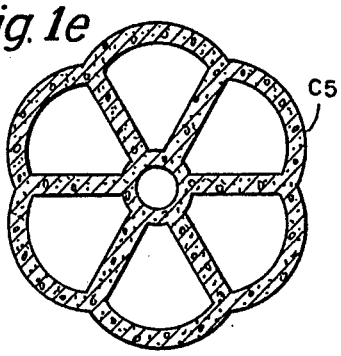
Figure 1F:
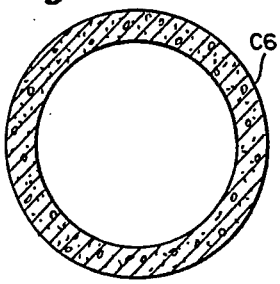

FIGS. 1(a)–(f) show six different cross-sections (C1–C6) of supporting column sections which may be used in the present method. Each column section to be used in a finished supporting column has substantially the same height and cross-section of other column sections forming the finished column. The cross-sectional dimensions of the column sections preferably are small in relation to their height, and the various cross-sectional shapes of the column sections illustrated in FIGS. 1(a)-(f) allow the column sections to withstand water or gas pressure, and the loads to be supported in the axial and lateral directions of the column sections, in a relatively economical manner. Typically, the column sections will have a circular or annular cross-section as shown in FIG. 1(f) and always will have an inner hollow space suitable for ballasting, storage, or for installation of conductors, risers, stairs, cages, drilling rods, measurement elements, and the like. The hollow space of the column sections also provides for buoyancy of the column section, such buoyancy being a significant factor which constributes to the ease with which the present installation method can be implemented.

As described further below, each of the column sections are joined coaxially end-to-end near the surface of the water as the joined column sections including a column base are submerged vertically toward the seabed. Finished columns formed by the column sections preferably are connected to one another at different heights by means of stiffening members so as to secure stability and rigidity of the whole structure.

It will also be apparent that conductors, risers and drilling tubes may be located exterior of the joined column sections in a finished installation.

A rigid or elastic slab or grid (not shown) for connecting the upper extremities of all the finished columns, may be positioned over, under, or at sea level, and should be capable of supporting a working platform.

Figure 2:
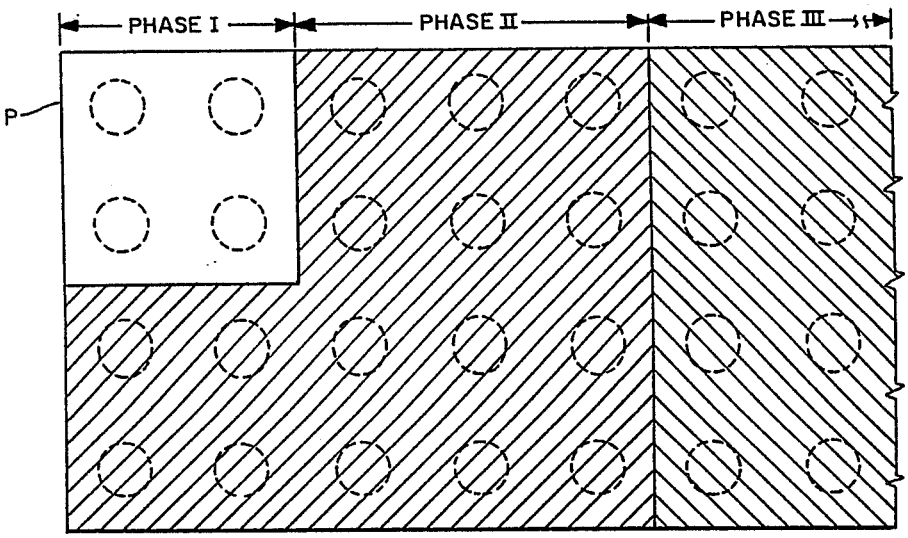
FIG. 2 is a plan view, on a reduced scale, of a platform supported by a number of columns, the platform having been enlarged in three phases.

The working platform, represented in FIG. 2, can be constructed in any of a number of different known designs, according to the type and scope of work to be performed on the platform. That is, the platform P should be capable of carrying all the machinery, drilling facilities, heliport and lodging facilities which may be called for by the technology involved and for commercial convenience.

According to the present method, the working platform initially can be relatively small as shown by Phase I in FIG. 2. The platform can be enlarged afterward once exploration operations confirm the feasibility of exploitation of wells (FIG. 2, Phase II), or enlarged even further later on, when production necessitates expansion of the exploitation cycle or storage capacity (FIG. 2, Phase III).

Figure 3:
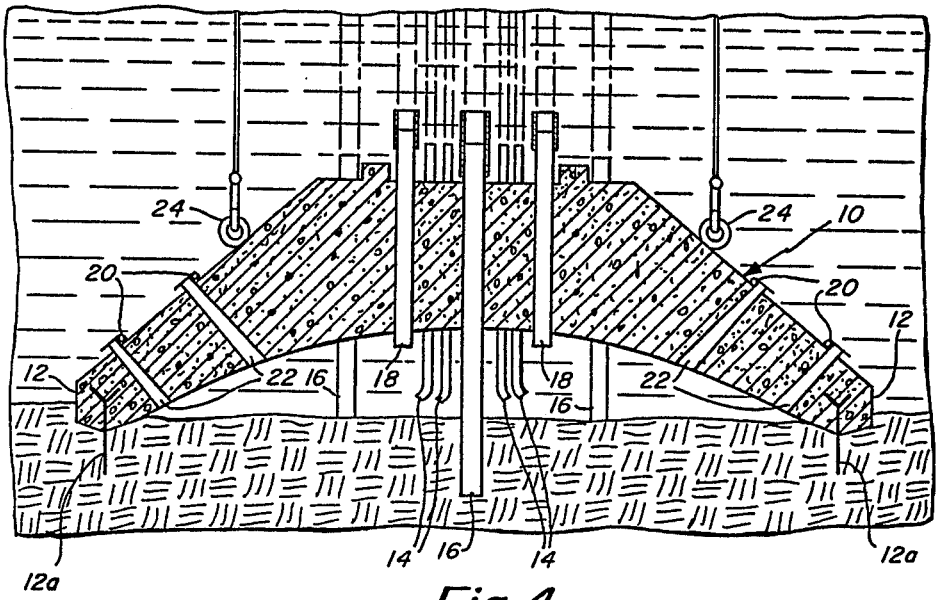
FIG. 3 is a cross section of a column base located on a seabed.

FIG. 3 shows a column base 10 on which the lowermost column section of a finished column is seated. The base 10 can be made of steel, or reinforced concrete, or may be a hybrid of reinforced concrete with steel skirts and tubes. The base 10 may be used both as a bearing element and as a drilling template. The overall shape of the base 10 including its area of foundation will depend on the quality of the sea bottom.

Accordingly, depending on the consistency and hardness of the seabed, the base 10 may be formed in various ways but, generally, will be in the form of a bell-shaped structure with either a continuous or an interrupted edge 12. The edge 12 may include a metallic skirt **12*a*** for penetration into the sea bed.

A number of pipes 14 may extend through the base parallel to the base axis to open in the region formed between the bottom of the base 10 and the surface of the seabed, as shown in FIG. 3. Air or water can be jetted out of the pipe openings at high pressure so as to allow for the elimination of unconsolidated layers of the seabed. A number of tubes 16 also can be arranged to extend through the base 10 parallel to the base axis to open against the surface of the seabed as shown in FIG. 3, the tubes 16 serving as guides for drilling. Further, a number of pipes 18 may extend through the base parallel to the base axis to open in the central bottom surface region of the base 10, as shown in FIG. 3, to allow grouting of the space formed between the bottom surface of the base 10 and the soil at the sea bottom, for purposes of enlarging the area of contact with supporting surfaces of the base 10, and to seal the exterior surfaces of steel skirts and tubes penetrating into the sea soil.

Valves 20 can be provided on the upper side surface of the base 10, as shown in FIG. 3, the valves 20 serving to control the passage of silt or sand through associated passageways 22 from the region below the base bottom when it is desired to expell the silt or sand. The valves 20 and passageways 22, of course, must be arranged to retain coarser material such as grouting used to fill the region below the bottom of the base 10.

Appropriate hooks or rings 24 also are provided on the upper surface of the base 10, as shown in FIG. 3, for allowing the base 10 to be temporarily suspended by means of cables from a hoisting system used in the present installation method.

In some instances, it may be desired to furnish the base 10 with instruments and devices for performing geophysical and geotechnical determinations as the base 10 approaches the seabed or when it later rests on the sea soil.

When installation of a platform begins at a new site, and a first base 10 is brought to rest on the sea bottom together with a finished supporting column, precise data relating to the quality and bearing conditions of the soil can be obtained pertinent to hammering, vibration or testing loads for the column. Afterward, the shape and foundation area of bases to be used for additional columns to be installed at the site, can be accurately determined so that the bases will be adapted to the actual seabed conditions, all at minimal cost.

Figure 4:
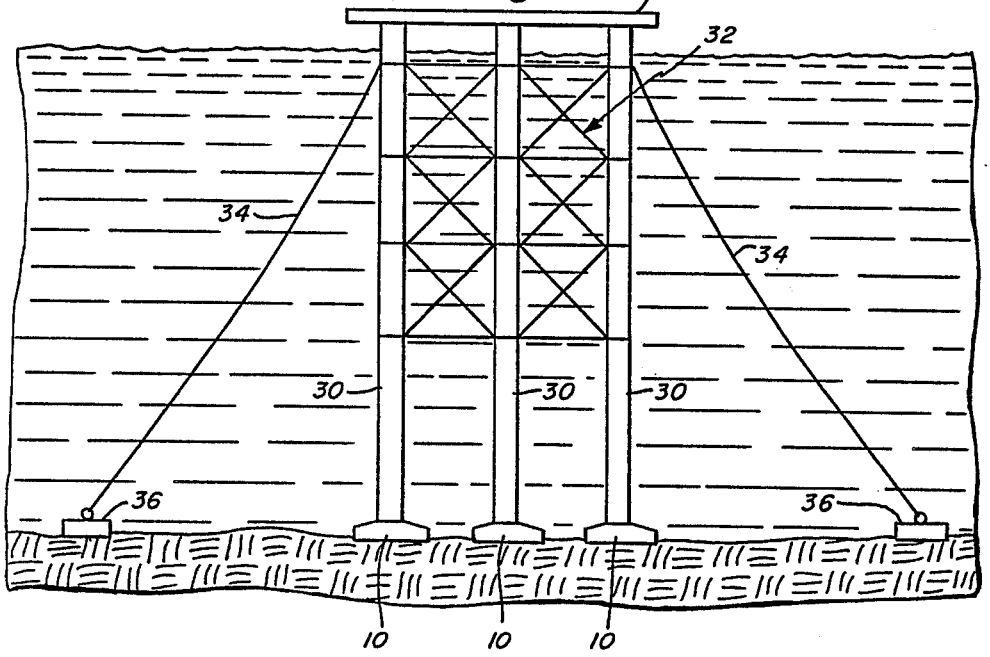
FIG. 4 is a side view, in a reduced scale, of a completed offshore construction supported by guys according to the invention.

As mentioned above, the finished columns are formed by a number of hollow column sections having any one of a number of different cross-sections such as shown in FIGS. 1 (a)-(f). Finished columns such as supporting columns 30 shown in FIG. 4 serve to provide means for transmitting static and dynamic forces arising from their own weight and the action of the loads on a working platform P to the sea soil, and allow for storage of ballast, oil, natural gas, LNG, water, fuel and the like, in the hollow interiors of the finished columns 30. In certain cases, the hollow interiors of the columns will allow for installation of drilling rods, piles, stairs, hoists, cages or other elements used in aide of drilling or in the performance of geophysical observations through instrumentation arranged in the bases 10 or in the lower portions of the columns 30.

A system of horizontal and inclined braces 32 will provide sufficient rigidity and stiffness to all of the columns 30 to insure the safe operation of the platform P. Depending on the type of columns, the braces 32 will be of different kinds and, in some cases, the stiffening provided by the braces will be complemented with guys 34 anchored to the sea bottom as at 36.

The individual column sections forming each of the finished supporting columns 30 can be made of steel or reinforced concrete. Each column section has a predetermined height and a substantially constant weight, with regular cross-sectional shapes and dimensions as shown in FIGS. 1 (a)-(f). Each of the column sections to be used also have at both ends suitable coupling devices allowing for the temporary or permanent joining of the sections to one another.

Steel or other metallic column sections contain a suitable internal steel lattice (FIGS. 1 (b), (c)), such lattice being capable of supporting such loads and lateral forces as the finished column must withstand. The internal steel lattice is surrounded by a cylindrical, conic, prismatic or pyramidal metallic plate capable of withstanding the pressure generated from outside by the sea water, and any pressure exerted from the interior of the column by liquid or gas contained therein, with sufficient water tightness. Sufficient cathodic protection against corrosion also must be provided for the metallic column sections.

Figure 5:
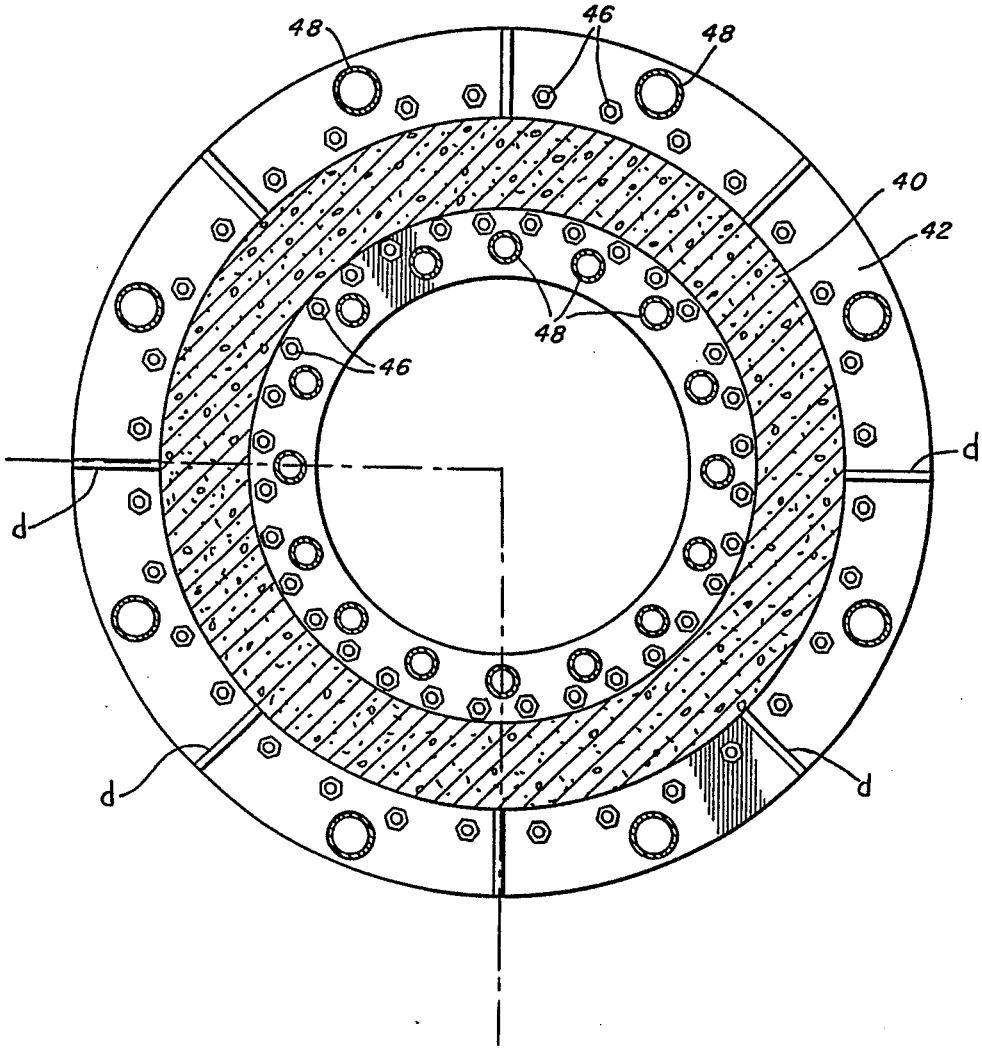
FIG. 5 is a cross-sectional view of a concrete column section with inner and outer supporting rings.
Figure 6:
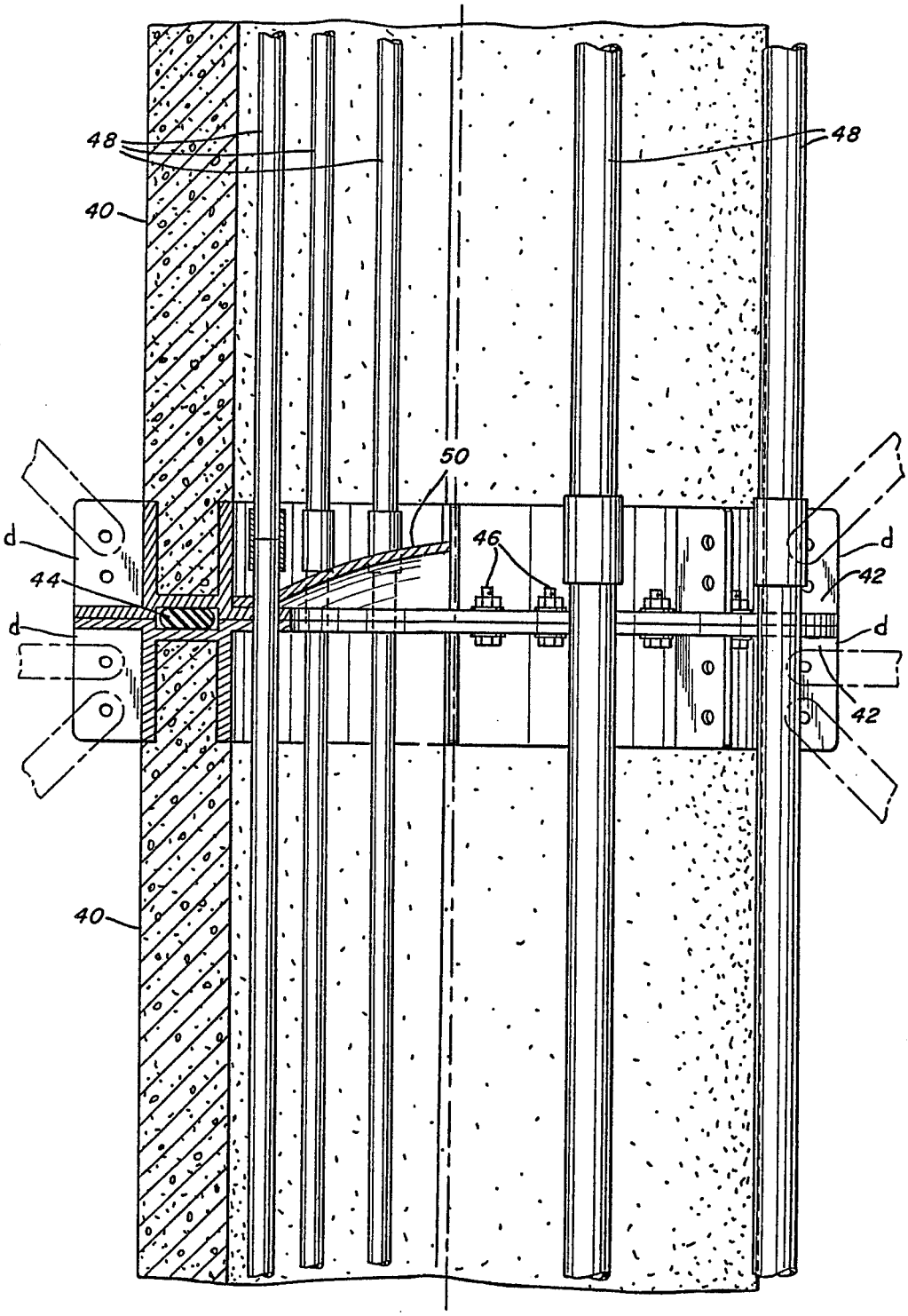
FIG. 6 is a partial cross-sectional view of two concrete column sections joined to one another.

A reinforced concrete column section 40, cross-sections of which are shown in FIGS. 5 and 6, also will be of substantially constant height and cross-sectional shape and dimensions. The column section 40 is made generally of prestressed or post-tensioned concrete, capable of withstanding both permanent and cyclical loads and lateral forces when joined with like column sections to form a finished column. As with the metallic column sections, the concrete column sections must be able to withstand pressures produced from outside by the sea water, and from inside by fluids contained in its interior hollow space. Internal and external coatings suitable to avoid permeability and corrosion, also should be provided on the concrete column sections 40.

As pressure and loads increase with the depth at which each column section will be positioned, both the metallic and concrete column sections must have lateral walls and structural elements of increasing resistance while maintaining either the internal or external shape and dimensions of the column sections unchanged. Such uniform shape and dimension is necessary to allow for readily joining the column sections to one another, as well as to facilitate continuity of tubes, pipes and the like which may extend through the interiors and exteriors (FIG. 7) of the joined column sections.

FIGS. 5 and 6 show coupling devices used for joining the ends of the column sections to one another, the coupling devices being suitable for either the metallic or concrete column sections although the concrete column section 40 is illustrated in FIGS. 5 and 6.

Each coupling device 42 is in the form of a metallic ring cap which may be in any desired configuration, but must at least be formed to be tightly joined to the top or bottom end of a column section and any interior structural elements in the column section so as to insure mechanical continuity and water tightness. Each coupling device 42 also must be shaped to house an hermetic packing washer or gasket 44 between the top of a lower column section and the bottom of an upper column section as shown in FIG. 6, to provide the required water tightness or air tightness, and the transmission of static and dynamic loads from one column section to the other with the required safety factor. Moreover, each coupling device 42 preferable should include such openings, forks or hooks to allow for attachment of the two successive column sections with rivets, bolts, or ball-and-spigot joints as shown at 46 in FIGS. 5 and 6. Instead, each coupling device 42 can be arranged to allow for field welding, or any other type of connection that complies with both mechanical and water tightness requirements.

Figure 7:
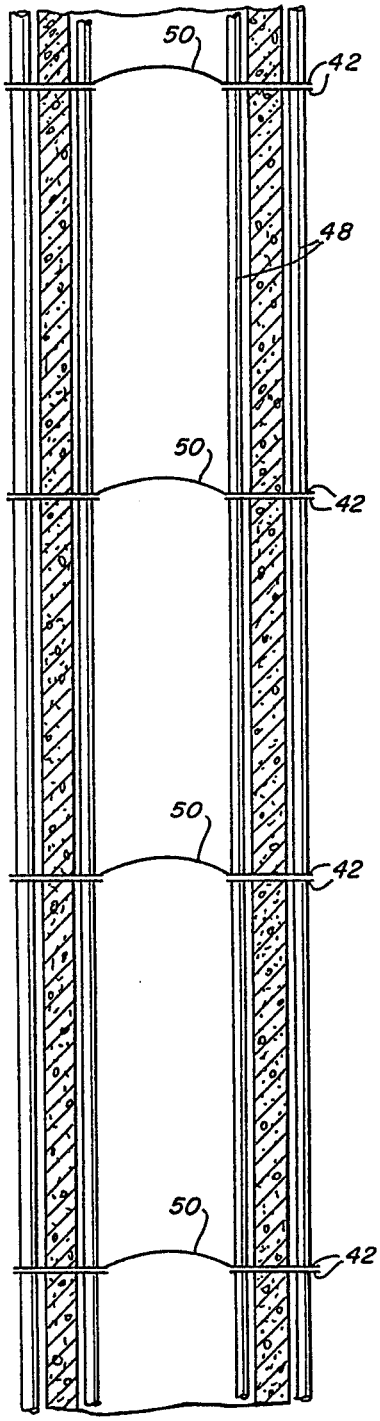
FIG. 7 is a cross-sectional view of a length of a finished column having separate interior column spaces.
Figure 8:
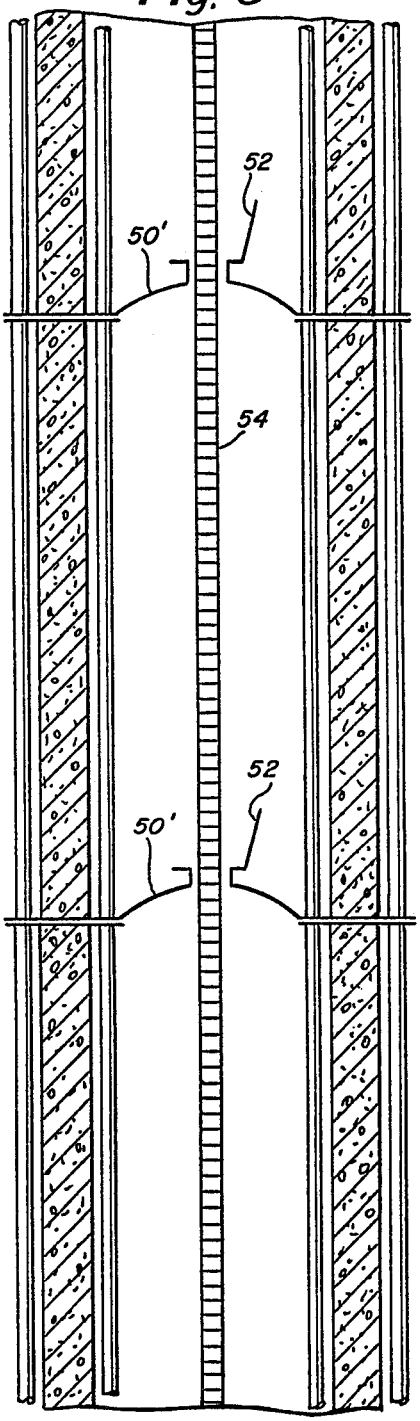
FIG. 8 is a cross-sectional view of a length of a finished column including a ladder inside the column.

Each coupling device 42 also should be arranged so that, when joined to one another, the devices 42 will provide means for guiding and supporting interior and/or exterior elements 48 such as conductors, risers, and the like used in exploration and exploitation work. Each coupling device 42 also can include means for allowing attachment of a hermetic diaphragm 50 as shown in FIG. 6, so as to separate the interior space of each column section in a finished supporting column for differential ballasting or storage of liquids or gas as shown in FIG. 7. FIG. 8 shows a modified form of diaphragm 50', which includes a sealed door 52 to permit the extension of a ladder 54 through the joined column sections when the door 52 is opened.

A significant advantage of the present method is that the column sections can be built on shore in a factory, or in situ from slipformed concrete or jump-formed concrete, with epoxy coated, galvanized, or stainless steel reinforcing bars to avoid corrosion. Preferaby, the column sections are prefabricated on shore and are towed or carried to the site by boat. Internal and external forces of concrete column sections should be protected with phenolic compounds or similar coatings to act as water-proofing agents.

Upmost parts of the finished columns also can be formed integrally in situ wherein the lower part of the column is formed with the column sections of uniform heights. Such might be appropriate when irregularities of the sea bottom call for the use of sections of different heights at the upper end of the columns, in order to establish a leveled bearing plane for the connecting pad. Generally, the height and/or weight of the individual column sections will be determined by the coastal yard or factory vessel facilities, by the method of transportation to the final location, and by the hoisting capacity and free height disposable with the vessels used to unload the column sections and set then in position to form the finished supporting columns.

Selection of the cross-sectional dimensions and wall thickness of the column sections to be used, must be carefully performed and should aim to equalize the weight of each section (including tubes, couplings, etc.) with the buoyancy of the section once it is completely submerged into the sea water.

Should the weight of each column section surpass the buoyant force, the difference as computed for all the sections comprising a finished column, plus the weight of the base 10 and the portion of the column which will rise above the sea level, the weight of tubes, pipes and the like, then must be within the loading capacity of the vessel hoists used for installation.

On the contrary, if the buoyancy of each column section exceeds its weight, some of the lower sections already joined must be ballasted temporarily in order to provide a sinking force, within the load capacity of the hoist, so as to allow immersion of the column and maintenance of a vertical direction during erection of the column and lowering of the column into its final position on the seabed.

FIGS. 9–12 illustrate the installation of a supporting column formed of column sections according to the present invention.

Individual column bases 10 and column sections 30 as prefabricated in coastal yards or in factory vessels, and completed with apertenant elements (not shown) such as conductors, risers, drilling tubes, and the coupling devices 42 (FIGS. 5 & 6), are brought to the installation site on cargo vessels or barges 60. One or more installation vessels 62 or catamarans 65 (FIG. 10) then serve to install the finished columns by taking the bases 10 and column sections 30 from the vessel or barge 60, and joining the bases and column sections by way of at least two different hoisting systems 64 and 66. The first hoisting system 64 is capable of supporting the whole finished column including the base 10 and additional apertenant elements, less the buoyancy of all the elements which will rest submerged. The second hoisting system 66 is capable of taking the column sections 30 individually from the vessels 60, and putting them into position to be attached to the other elements of each column, near the surface of the sea waters.

Figure 9:
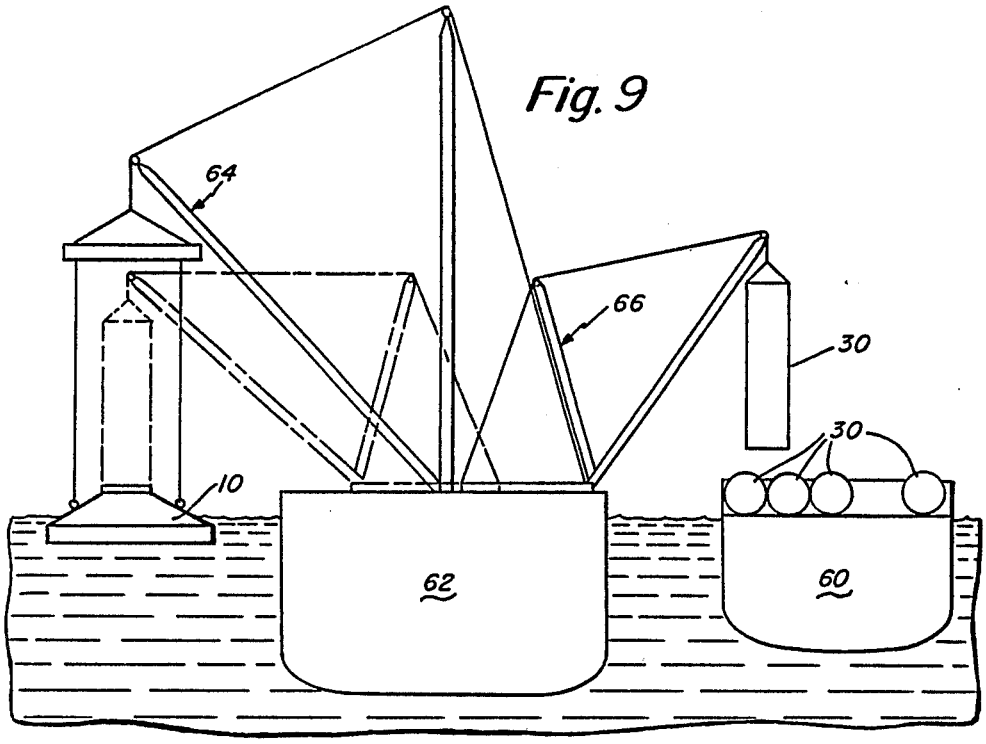
FIG. 9 is a view of a single vessel placing a first column section on a column base near the waters' surface.
Figure 10:
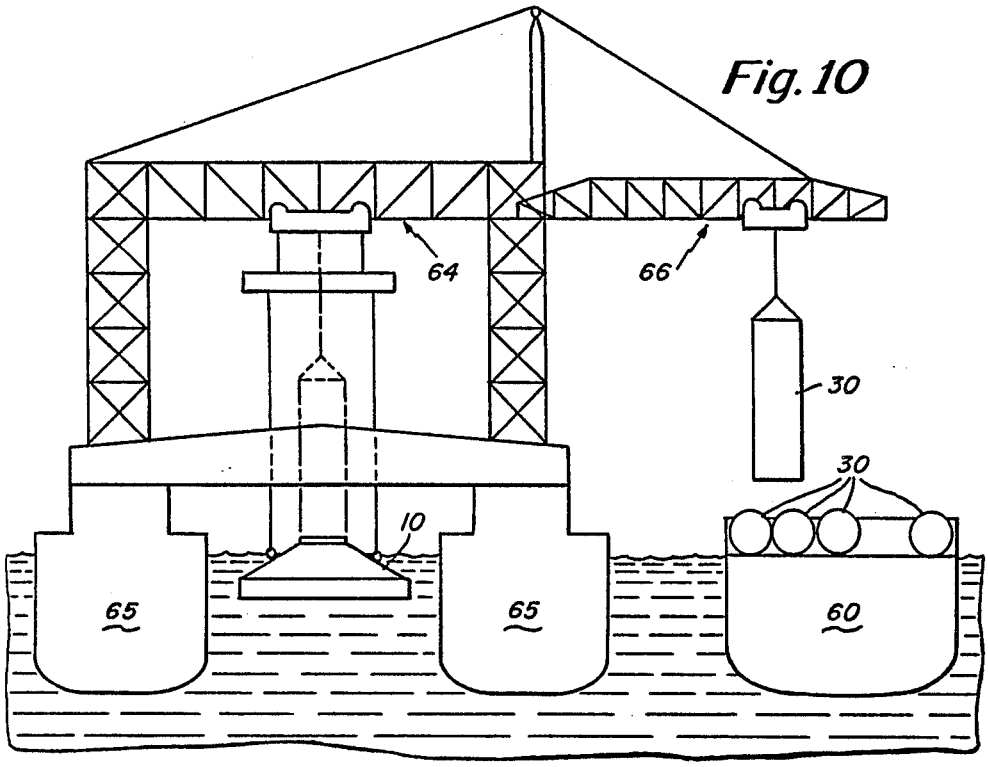
FIG. 10 is a view of a catamaran placing a first column section on a column base near the waters' surface.

When the first hoisting system 64 starts an installation for a column, the system 64 takes the base 10 associated with the column, and lifts it in the vertical line of the final column position, near the waters' surface as shown in FIGS. 9 and 10. Then, the second hoisting system 66 takes a first column section 30 and places it onto the base 10 as shown in dotted lines in FIGS. 9 and 10, so as to allow a crew to attach the first column section 30 to the base 10 with bolts or by welding and the like, and to fasten the unions of all the other apertenant elements such as tubes, pipes and the like.

Figure 11:
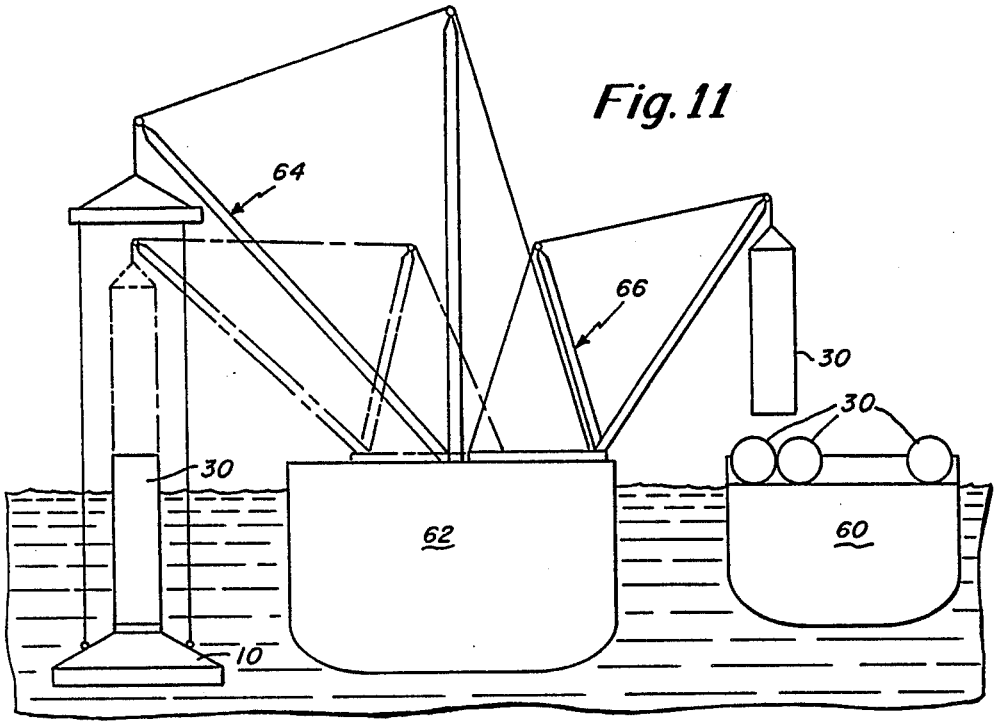
FIG. 11 is a view of the vessel placing a second column section on top of the first column section as partly submerged.
Figure 12:
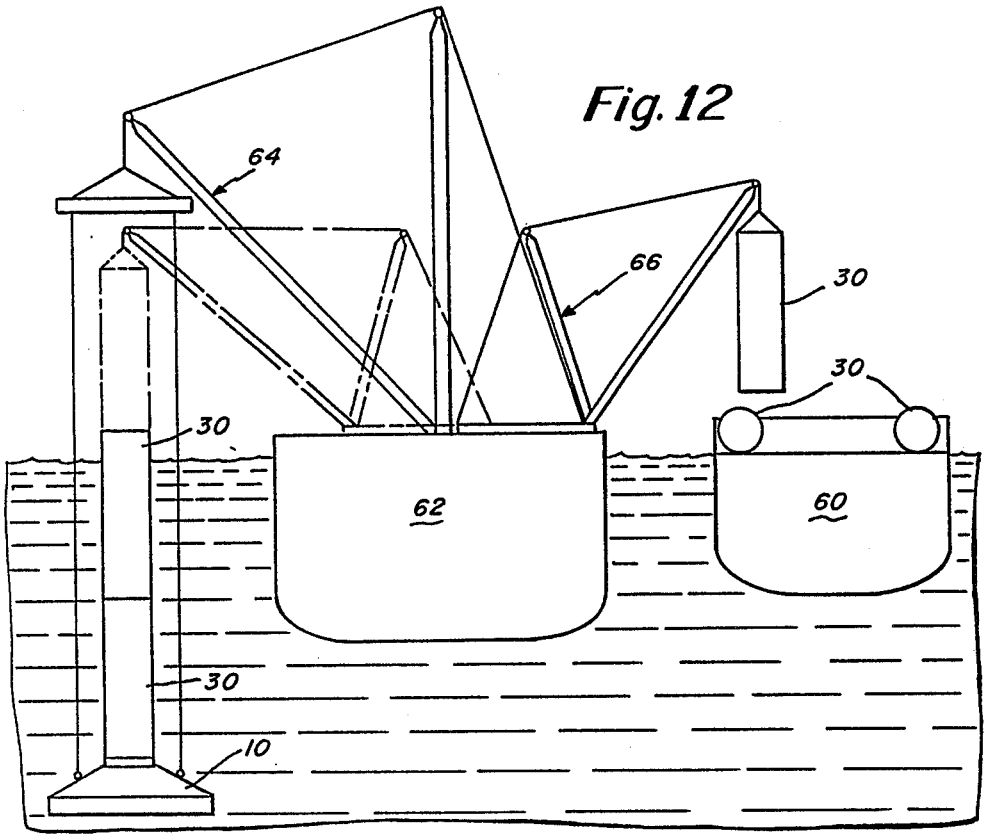
FIG. 12 is a view of the vessel placing a third column section on top of the second column section as partly submerged.

Once the connections of the first column section 30 to the base 10 is completed, the first hoisting system 64 lowers the ensemble as deep as to allow the second hoisting system 66 to place a second column section 30 on top of the first column section already attached to the base 10 near the waters' surface, as shown in FIG. 11. All the required connections and attachments must then be performed.

The first hoisting system 64 then lowers the second column section as joined to the first column section and the base to the same height above the waters' surface as with the first column section, and the joining operation for additional column sections 30, is continued until a finished column of desired height is obtained.

After each finished column rests on the seabed, it is maintained in a vertical position by means of stiffening members and temporary or permanent anchored guys.

After the crew installs a finished column, a second crew can performed the clearing and consolidating of the base 10, such as by using jets of water or air at high pressure, the filling of voids beneath the bases, and the sealing of tubes and skirts inserted into the soil, as mentioned above. Meanwhile, the first crew can begin to form the next column a certain distance from the column already finished.

After each column rests on its final position on the seabed, a third crew may finish the upper portion of that column by casting it in situ to the exact required level where the connecting pad or grid would be attached.

Offshore constructions installed according to the present method provide significant advantages. First, the size and configuration of the platform may be altered or enlarged once exploration carried out from the platform reveals that such enlargement would be commercially beneficial. Second, the column sections, like the known gravity structures, can use their own weight to obtain stability without the need of driving piles in order to fix the structure. Also, the hollow column sections allow for a large storage capacity for oil, natural gas, or even LNG, thus avoiding the need of oil or gas pipelines and making feasible the exploitation of wells far from coastal storage facilities or existing pipelines.

As mentioned above, anchoring of the individual column during construction is a temporary or provisional way to keep the columns at a vertical position, if needed, during the construction of the platform. However, after the stiffening members and interconnections between adjacent columns are installed, this permits the complete structure to support all of the loads without requiring permanent anchorage. After installation of the stiffening members, the temporary anchorage can be removed, and the whole assembly has sufficient rigidity and stability to withstand all applied loads without requiring additional anchorage to the seabed.

Importantly, the column sections and platform can be located anywhere, regardless of the quality and topography of the foundation soils, and the distance from existing oil lines or coastal storage facilities. Such feature is not present with any of the known offshore constructions. Accordingly, great savings in cost and time can be realized until the start of exploitation of the platform, particularly in that the prior requirement of overdimensioning of structural, supporting and linking elements is no longer required with the present installation method, nor are expensive prior measurements of a large area of the sea bottom.

The base members, shown as separate members in the drawings, can be integrally formed with a first column section, as desired.

An important advantage of the present invention is that the individual column sections, after being used, can be disassembled and re-sued. The disassembly is relatively easily accomplished—since the columns are mostly submerged during the disassembly process, large hoisting equipment is not required due to the buoyancy effect. This increases the economical aspect of the present invention. In a typical case, disassembly is carried out by arranging the columns so that the uppermost column section is near the surface of the body of water, disconnecting the uppermost column section from the column, raising the column so that the next uppermost column section is near the surface of the body of water, disconnecting said next uppermost column section from the column, and repeatedly raising and disconnecting additional ones of the column sections from the top of the column until the column is disassembled. As the column sections are disconnected, they may be stored, for example on a boat. In a similar manner, the bracing members between adjacent columns of a group of columns can be disconnected and re-used.

While specific embodiments of the invention have been shown and described in detail to illustrate the application of the inventive principles, it will be understood that the invention may be embodied otherwise without departing from such principles.

I claim:

1. A method of constructing and installing an offshore gravity structure type construction in a body of water, by assembling columns one-by-one using column sections for each individual column, comprising the steps of:

(a) providing a number of hollow, unconnected supporting column sections;

(b) transporting a plurality of said unconnected column sections to a construction site on a sea going vessel;

(c) providing only one construction vessel with at least two hoisting systems thereon;

(d) arranging, with one hoisting system on said one construction vessel, a single first one of the column sections for a single column near the surface of a body of water;

(e) at least partly submerging with said one hoisting system the single first column section for said single column in the body of water by a certain amount;

(f) placing, with another of said at least two hoisting systems, a single second one of the column sections on the top of the first column section and joining the top of the first column section to the bottom of the single second column section near the surface of the body of water to thereby build up a single column;

(g) at least partly submerging with said one hoisting system the second column section as jointed to the first column section by a depth substantially equal to the length of the second column section;

(h) repeatedly placing with said another hoisting system on said one construction vessel additional single ones of the column sections, one-by-one, on top of each of the column sections after each column section is at least partly submerged with said one hoisting system on said one construction vessel, and joining the tops of the partly submerged column sections to the bottoms of the additional column sections near the waters' surface until a single column of desired height, and having its bottom resting by gravity on the bed of the body of water, is formed by the joined column sections; and (i) repeating steps (d) to (h) to form at least a second individual column of desired height by joining a plurality of column sections one-by-one, said second column being spaced from said first mentioned column, said steps (d) to (h) being repeated until a desired plurality of columns are erected in a desired arrangement relative to each other with only said single construction vessel.

2. The method of claim 1, including anchoring the column formed by the joined column sections to the seabed to maintain the column in a vertical position.

3. The method of claim 1, comprising:

providing a separate column base for each column;

placing said column base near the surface of the body of water; and joining the bottom of the first column section to the base near the surface of the body of water before the first and second column sections are joined.

4. The method of claim 1, wherein a plurality of the column sections are of substantially the same length.

5. The method of claim 1, wherein a plurality of the column sections have substantially the same cross-section.

6. The method of claim 1, including erecting a number of additional columns spaced from each other and based at different positions on the seabed each by repeatedly placing column sections successively on top of at least partly submerged column sections and joining the tops of the at least partly submerged column sections to the bottoms of the successively placed column sections.

7. The method of claim 1, including forming each column section to have a buoyancy about equal to the weight of the column section.

8. The method of claim 6, including adjustable bracing members for bracing portions of all of the columns formed by the joined column sections to one another.

9. the method of claim 8, wherein upper portions of the columns are braced together by said adjustable bracing members.

10. The method of claim 8, including guying the braced columns with guy wires and anchoring the guy wires in the seabed.

11. The method of claim 6, including positioning a platform on top of the columns formed by the joined column sections.

12. The method of claim 6, including finishing each of the columns formed by the joined column sections by placing additional column sections of particular lengths, sufficient to reach a predetermined level, so as to compensate for irregularities in the conformation or settlement of the bottom of the body of water, on top of the joined column sections, and joining the additional column sections to the already joined column sections.

13. The method of claim 12, including placing a platform on top of the finished columns.

14. The method of claim 1, including transporting the column sections in a first vessel to an installation site on the waters' surface, providing as said one vessel a second vessel having first and second hoisting systems at the installation site, unloading the first column section from the first vessel with the first hoisting system on the second vessel, suspending the first column section near the waters' surface from the first hoisting system, unloading the second column section from the first vessel with the second hoisting system of the second vessel and placing the second column section on top of the first column section as suspended from the first hoisting system, and partly submerging at least a portion of the first column section using the first hoisting system after joining the first and second column sections.

15. The method of claim 14, including unloading a third column section from the first vessel with the second hoisting system, and placing the third column section on top of the second column section as suspended in the water from the first hoisting system.

16. The method of claim 13, including erecting a number of additional finished columns formed of column sections, locating the additional finished columns in the vicinity of the finished columns which support the platform, arranging an additional platform on the additional finished columns, and joining the additional platform to the one previously located, thereby providing an enlarged platform.

17. The method of claim 13, including storing materials in the interior spaces of at least some of the hollow column sections forming the finished columns.

18. The method of claim 13, including measuring physical conditions associated with the waters in the vicinity of the platform by placing measurement devices in the interior spaces of at least some of the hollow column sections forming the finished columns.

19. The method of claim 1, including separating the interior spaces of at least some of the adjacent hollow column sections from one another to obtain separated storage areas.

20. The method of claim 6, comprising guying the individual columns to the seabed; connecting the columns to each other by bracing; and removing the guying from the individual columns after bracing them together.

21. The method of claim 1, comprising disassembling said column of desired height by the steps of:

arranging the column so that the uppermost column section is near the surface of the body of water;

disconnecting the uppermost column section from the column;

raising the column so that the next uppermost column section is near the surface of the body of water;

disconnecting said next uppermost column section from the column; and repeatedly raising and disconnecting additional ones of the column sections from the top of the column until the column is disassembled.

22. The method of claim 1, comprising fabricating said hollow, unconnected supporting column sections of reinforced concrete.

* * * * *